US011672273B2

(12) United States Patent
Jordil et al.

(10) Patent No.: US 11,672,273 B2
(45) Date of Patent: Jun. 13, 2023

(54) AEROSOL GENERATING ARTICLE WITH IMPROVED MOUTH END CAVITY

(71) Applicant: PHILIP MORRIS PRODUCTS S.A., Neuchatel (CH)

(72) Inventors: Yves Jordil, Neuchatel (CH); Leonardo Nappi, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 123 days.

(21) Appl. No.: 16/762,578

(22) PCT Filed: Nov. 28, 2018

(86) PCT No.: PCT/EP2018/082873
§ 371 (c)(1),
(2) Date: May 8, 2020

(87) PCT Pub. No.: WO2019/106028
PCT Pub. Date: Jun. 6, 2019

(65) Prior Publication Data

US 2020/0281255 A1 Sep. 10, 2020

(30) Foreign Application Priority Data

Nov. 28, 2017 (EP) ..... 17204218

(51) Int. Cl.
*A24D 3/18* (2006.01)
*A24C 5/47* (2006.01)
(Continued)

(52) U.S. Cl.
CPC ..... *A24D 1/20* (2020.01); *A24C 5/01* (2020.01); *A24C 5/47* (2013.01); *A24D 3/0291* (2013.01); *A24D 3/10* (2013.01); *A24D 3/18* (2013.01)

(58) Field of Classification Search
CPC ..... A24C 5/56; A24C 5/477; A24D 3/18
See application file for complete search history.

(56) References Cited

U.S. PATENT DOCUMENTS 4,675,064 A 6/1987 Berger
10,779,564 B2 9/2020 Treadaway
(Continued)

FOREIGN PATENT DOCUMENTS

CN 2018/21900 5/2011
CN 102697180 10/2012
(Continued)

OTHER PUBLICATIONS

PCT Search Report and Written Opinion for PCT/EP2018/082873 dated Feb. 25, 2019 (10 pages).
(Continued)

*Primary Examiner* — Cynthia Szewczyk
(74) *Attorney, Agent, or Firm* — Mueting Raasch Group

(57) ABSTRACT

An aerosol-generating article (10) comprising: an aerosol generating substrate (12); and a mouthpiece (14) disposed downstream of the aerosol-generating substrate (12). The mouthpiece (14) comprises a hollow tubular segment (24) at its downstream end defining a mouth end cavity (40), and the hollow tubular segment (24) comprises a hollow tube (31) of fibrous material, and a polymeric film (35) secured to the inner surface (311) of the hollow tube (31).

18 Claims, 2 Drawing Sheets

(51) Int. Cl.

| | |
|---|---|
| ***A24C 5/56*** | (2006.01) |
| ***A24D 1/20*** | (2020.01) |
| ***A24C 5/01*** | (2020.01) |
| ***A24D 3/02*** | (2006.01) |
| ***A24D 3/10*** | (2006.01) |

(56) References Cited

U.S. PATENT DOCUMENTS

| | | | | |
|---|---|---|---|---|
| 2003/0027007 | A1* | 2/2003 | Wieczorek, Jr. ... | C09J 123/0869 428/522 |
| 2011/0100386 | A1* | 5/2011 | Watters ..... | A24D 1/02 131/332 |
| 2014/0238427 | A1 | 8/2014 | Tanasheva | |
| 2015/0208720 | A1* | 7/2015 | Kadiric ..... | A24D 3/048 131/281 |
| 2015/0272207 | A1 | 10/2015 | Reed | |
| 2017/0215475 | A1* | 8/2017 | Besso ..... | H01M 10/0525 |
| 2018/0027870 | A1* | 2/2018 | Kadiric ..... | A24D 3/04 |
| 2018/0310624 | A1* | 11/2018 | Parker ..... | A24C 5/01 |

FOREIGN PATENT DOCUMENTS

| | | | | |
|---|---|---|---|---|
| CN | 102763897 | | 11/2012 | |
| CN | 102770034 | | 11/2012 | |
| CN | 102770034 | A * | 11/2012 | ..... A24B 15/00 |
| DE | 2327822 | A * | 12/1974 | ..... A24C 5/56 |
| EP | 2583570 | | 2/2015 | |
| EP | 2910134 | | 8/2015 | |
| EP | 3000335 | | 3/2016 | |
| JP | S5279097 | | 7/1977 | |
| RU | 2609394 | | 2/2017 | |
| WO | WO 2014/023555 | | 2/2014 | |
| WO | WO 2015/101605 | | 7/2015 | |
| WO | WO 2016/156223 | | 10/2016 | |

OTHER PUBLICATIONS

Office Action issued in Russia for Application No. 2020120419/03 dated Dec. 28, 2021 (22 pages). English translation included.

Office Action issued in China for Application No. 201880073088.6 dated Nov. 13, 2022 (19 pages). English translation included.

* cited by examiner

AEROSOL GENERATING ARTICLE WITH IMPROVED MOUTH END CAVITY

This application is a U.S. National Stage Application of International Application No. PCT/EP2018/082873 filed Nov. 28, 2018, which was published in English on Jun. 6, 2019 as International Publication No. WO 2019/106028 A1. International Application No. PCT/EP2018/082873 claims priority to European Application No. 17204218.6 filed Nov. 28, 2017.

The invention relates to aerosol-generating articles having a mouth end cavity. The invention is particularly applicable to filter cigarettes having a mouth end cavity.

Filter cigarettes are one example of aerosol-generating articles. Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with muffin component filters that comprise two or more segments of filtration material for the removal of particulate and gaseous components of the mainstream smoke are also known. Aerosol-generating articles having a cavity at their mouth end have also been proposed.

A number of aerosol-generating articles in which an aerosol forming substrate, such as tobacco, is heated rather than combusted have also been proposed in the art. In heated aerosol-generating articles, the aerosol is generated by heating the aerosol forming substrate. Known heated aerosol-generating articles include, for example, aerosol-generating articles in which an aerosol is generated by electrical heating or by the transfer of heat from a combustible fuel element or heat source to an aerosol forming substrate. During use, volatile compounds are released from the aerosol forming substrate by heat transfer from the heat source and entrained in air drawn through the aerosol-generating article. As the released compounds cool, they condense to form an aerosol that is inhaled by the consumer. Also known are aerosol-generating articles in which a nicotine-containing aerosol is generated from a tobacco material, tobacco extract, or other nicotine source, without combustion, and in some cases without heating, for example through a chemical reaction.

As noted above, in some cases, an aerosol-generating article may have a cavity at its mouth end. Such mouth end cavities are typically formed by extending the plug wrap, the tipping paper, or both the plug wrap and the tipping paper of the filter beyond the most downstream filter segment. The mouth end cavity may be alternatively or additionally formed by a hollow tubular segment at the mouth end of the aerosol-generating article.

A number of solutions have been proposed for providing the inner surface of the mouth end cavity with a distinctive appearance, such as a distinctive colour or indicia. For example, EP 2 583 570 B1 describes a filter cigarette having a mouth end cavity formed by extending the plug wrap and the tipping paper of the filter beyond the most downstream filter segment, and printing an indicia on the inner surface of the plug wrap. However, this solution may not always be effective. For example, this solution may not be effective when the mouth end cavity is formed by a discrete hollow tubular segment, such as a hollow tube of fibrous material, because it is not possible to easily print onto such fibrous material.

It would therefore be desirable to provide an aerosol-generating article having a mouth end cavity with a distinctive appearance, such as a distinctive colour or indicia. It would be further desirable to provide an aerosol-generating article having a mouth end cavity with a distinctive appearance, where the mouth end cavity is formed by a discrete hollow tubular segment, such as a hollow tube of fibrous material.

According to a first aspect of the present invention, there is provided an aerosol-generating article comprising: an aerosol generating substrate; and a mouthpiece disposed downstream of the aerosol-generating substrate. The mouthpiece comprises a hollow tubular segment at its downstream end defining a mouth end cavity. The hollow tubular segment comprises a hollow tube of fibrous material, and a polymeric film secured to the inner surface of the hollow tube.

In an implementation of the first aspect of the present invention, there is provided an aerosol-generating article comprising: an aerosol generating substrate; and a mouthpiece disposed downstream of the aerosol-generating substrate, wherein the mouthpiece comprises a hollow tubular segment at its downstream end defining a mouth end cavity, and wherein the hollow tubular segment comprises a hollow tube of fibrous material, and a polymeric film secured to the inner surface of the hollow tube, and wherein the fibrous material of the hollow tube comprises fibers formed of a first type of polymer and the polymeric film comprises at least about 20 percent of the first type of polymer.

By securing a polymeric film to the inner surface of the hollow tube of fibrous material, the mouth end cavity of the article of the present invention can have a distinctive appearance over the cavities of prior art articles. The polymeric film may be easily provided with a base colour, provided with an indicia, or both provided with a base colour and an indicia, to thereby provide the mouth end cavity with a distinctive appearance.

Furthermore, a polymeric film can provide a more suitable component for securing to the inner surface of a hollow tube of fibrous material, than other possible components, such as printed paper. This is because the polymeric film can be more easily attached to fibrous material than other material, such as the likes of printed paper. In contrast to other materials, such as the likes of printed paper, the polymeric film may not collapse or deform after being secured to the inner surface of the hollow tube. The polymeric film may therefore provide an improved appearance over such alternative materials.

As used herein, the terms "upstream" and "downstream" are used to describe the relative positions of features of the aerosol-generating article according to the invention in relation to the direction of aerosol drawn from the aerosol generating substrate through the mouthpiece during use. For example, in a mouthpiece where a cavity is upstream of a mouth end segment, aerosol is drawn first through the cavity and then through the mouth end segment.

The term "inner surface" is used throughout the specification to refer to the surface of a component of the aerosol-generating article that is facing towards the interior of the aerosol-generating article. On the other hand, the term "outer surface" is used throughout the specification to refer to the surface of a component of the article that is facing towards the exterior of the article. For example, a wrapper circumscribing a mouthpiece segment comprises an outer surface that is facing the exterior of the aerosol-generating article and an inner surface that is facing towards the mouthpiece segment.

The fibrous material of the hollow tube may comprise fibers formed of a first type of polymer, and the polymeric film may comprise at least about 20 percent by weight of the first type of polymer. This can advantageously means that the material of the polymeric film and the material of the hollow tube can have the same or similar properties to one another. This may help to improve the attachment between the polymeric film and the hollow tube.

The hollow tubular segment may further comprise a binder for binding the fibers of the hollow tube together and for binding the polymeric film to the inner surface of the hollow tube. This may help to improve the attachment between the polymeric film and the hollow tube. The use of such a binder is particularly beneficial when the fibrous material of the hollow tube comprises fibers formed of a first type of polymer, and the polymeric film comprises at least 20 percent by weight of the first type of polymer. This is because the binder can interact with the first type of polymer in the fibers and polymeric film to secure fibers at the inner surface of the hollow tube to the polymeric film. This is particularly advantageous when the binder is a solvent for the fibers of the first type of polymer.

The polymeric film may comprise at least about 40 percent by weight of the first type of polymer, more preferably at least about 60 percent by weight of the first type of polymer, even more preferably at least about 80 percent by weight of the first type of polymer. In some embodiments, the polymeric film consists solely of the first type of polymer. The polymeric film may comprise less than about 95 percent by weight of the first type of polymer. This can help to ensure that a sufficient amount of the first polymer in the polymeric film is at the surface of the polymeric film. This means that a sufficient amount of the first polymer in the polymeric film is able to react with the binder and thus become secured to the fibers at the inner surface of the hollow tube by the binder.

The fibrous material of the hollow tube may comprise fibers formed of at least about 40 percent by weight of the first type of polymer, more preferably at least about 60 percent by weight of the first type of polymer, even more preferably at least about 80 percent by weight of the first type of polymer. In some embodiments, the fibrous material of the hollow tube may comprise fibers consisting solely of the first type of polymer. The fibrous material of the hollow tube may comprise fibers comprising less than about 95 percent by weight of the first type of polymer. The fibres comprising the first type of polymer may form at least about 80 percent by weight of all of the fibres in the fibrous material of the hollow tube. The fibres comprising the first type of polymer may form essentially all of the fibres in the fibrous material of the hollow tube.

The first type of polymer of the fibrous material and the polymeric film may be polylactic acid (PLA) or an acetate ester of cellulose. That is, the fibrous material may comprise fibres comprising an acetate ester of cellulose and the polymeric film may comprise an acetate ester of cellulose. In some embodiments, the fibrous material of the hollow tube may comprise fibers formed of at least about 80 percent by weight of an acetate ester of cellulose and the polymeric film may comprise at least about 80 percent by weight of an acetate ester of cellulose. In some embodiments, the fibrous material of the hollow tube may comprise fibers consisting solely of an acetate ester of cellulose and the polymeric film may consist solely of an acetate ester of cellulose. The acetate ester of cellulose may be selected from the group of cellulose acetate, cellulose diacetate and cellulose triacetate. The acetate ester of cellulose may be cellulose diacetate.

The first type of polymer of the fibrous material and the polymeric film may be polylactic acid (PLA). That is, the fibrous material may comprise fibres comprising polylactic acid and the polymeric film may comprise polylactic acid. In some embodiments, the fibrous material of the hollow tube may comprise fibers formed of at least about 80 percent by weight polylactic acid and the polymeric film may comprise at least about 80 percent by weight of polylactic acid. In some embodiments, the fibrous material of the hollow tube may comprise fibers consisting solely of polylactic acid and the polymeric film may consist solely of polylactic acid.

Where a binder is provided, the binder may be an ester of glycerol. The ester of glycerol may be triacetin (also known as glycerol triacetate). The ester of glycerol may be triethyl citrate, as an alternative or in addition to triacetin.

The combination of a first type of polymer in the form of an acetate ester of cellulose and a binder in the form of an ester of glycerol can be particularly advantageous. This is because, unlike conventional adhesives, the ester of glycerol interacts with the acetate ester of cellulose in the hollow tube and polymeric film, to bond or otherwise weld the outer surface of the polymeric film to the fibers on the inner surface of the hollow tube. For example, the acetyl groups of the ester of glycerol can interact with the acetate ester of cellulose through dipolar interactions and hydrogen bonding. This can form a secure attachment between the film and the tube, and leaves the inner surface of the hollow tubular segment with a desirable appearance. Furthermore, because binders in the form of an ester of glycerol are often used when manufacturing hollow tube of fibrous material to act as a plasticiser for the tube, the polymeric film can be advantageously secured to the hollow tube during the process of manufacturing the tube. This may allow for the hollow tubular segment of the present invention to be manufactured on existing machinery using existing processes and techniques, with little or no modification.

The polymeric film may be composed of additional compounds in addition to the acetate ester of cellulose. However, preferably, the polymeric film consists essentially of an acetate ester of cellulose. This can help to ensure that sufficient acetate ester of cellulose is present at the surface of the polymeric film and therefore able to react with the ester of glycerol binder.

The polymeric film may be a single layer film comprising the first polymer, preferably in the form of an acetate ester of cellulose. The polymeric film may be a multilayer film, with at least one layer comprising the first polymer, preferably in the form of an acetate ester of cellulose. Said at least one layer is preferably disposed on the outer surface of the polymeric film. That is, said at least one layer comprising the first polymer is preferably disposed adjacent to the inner surface of the hollow tube. In some embodiments, the polymeric film comprises a layer comprising a second polymer, such as a layer of polyvinyl alcohol, disposed between two layers comprising the first polymer.

The hollow tubular segment may comprise an adhesive for securing the polymeric film to the inner surface of the hollow tube. The adhesive may be Polyvinyl alcohol (PVA) or a hot melt adhesive. The adhesive may comprise polypropylene. The adhesive may comprise ethylene-vinyl acetate or ethylene-ethyl acrylate. The adhesive may comprise polyethylene.

The thickness of the polymeric film may be about 10 micrometres or more. The thickness of the polymeric film may be about 100 micrometres or less. The thickness of the polymeric film may be between about 10 micrometres and about 90 micrometres. The thickness of the polymeric film may be between about 14 micrometres and about 90 micrometres. Using such a thickness of polymeric film can help to reduce the risk of wrinkles appearing in the polymeric film when it is secured to the hollow tube.

The hollow tubular segment may have a substantially annular cross section. That is hollow tube segment may be formed from a hollow tube that is an annular shaped segment of filtration material, such as cellulose acetate. The annular shaped hollow tube has a hollow core extending from the upstream end of the annular shaped segment to the downstream end of the annular shaped segment. Such segments may be referred to as a hollow acetate tube. The hollow core may have a substantially constant cross-sectional area for the aerosol to flow through. This provides a substantially cylindrical surface for the polymeric film to be secured to.

The polymeric film may be secured to the entire inner surface of the hollow tube of fibrous material. The polymeric film may therefore extend along the entire length of the hollow tube. This can help to ensure that at least a portion of the polymeric film is always visible at the mouth end of the aerosol-generating article, regardless of the orientation of the hollow tubular segment in the aerosol-generating article.

The polymeric film may alternatively only extend along a first part of the length of the hollow tube. In such embodiments, the first part of the hollow tube is disposed at the downstream end of the hollow tube. This can help to ensure that at least a portion of the polymeric film is always visible at the mouth end of the aerosol-generating article.

The polymeric film may have a base colour, may be provided with an indicia, or may have both a base colour and be provided with an indicia. The base colour may be provided by including a dye in the polymeric film, or may be inherent in the material of the polymeric film. The indicia may be printed onto the inner surface of the polymeric film. The polymeric film may have a colour that is different to the colour of the hollow tube. For example, if the hollow tube appears substantially or wholly white, then the polymeric film may have base colour, which is substantially or wholly non-white.

The term "indicia" is used to refer to a discrete printed element, or repeating printed elements or patterns that provides an aesthetically pleasing representation. The indicia may be in the form of text, images, letters, words, logos, patterns or a combination thereof. For example, the indicia on the inner surface of the mouth end cavity according to the present invention may comprise a brand or manufacturer logo that allows the consumer to identify the type or origin of the smoking article. Alternatively, the indicia may comprise a repeating printed element or pattern on the inner surface of the wrapper material. The indicia may be generally aligned with the axis of the aerosol-generating article, generally perpendicular with the axis of the aerosol-generating article, or at an angle other than parallel or perpendicular with the aerosol-generating article. In addition, different indicia could be provided on a number of aerosol-generating articles that are sold together. For example, in one package the aerosol-generating articles may include two or more different types of indicia. In addition, the indicia could be presented in a way that presents a message, for example with the indicia on adjacent aerosol-generating articles in a package visible when the packaging is opened and the visible indicia spelling a word or otherwise collectively conveying a message.

The aerosol-generating article of the present invention comprises an aerosol-forming substrate. As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

The aerosol-generating article of the present invention may be configured for use with an aerosol-generating device. As used herein, an 'aerosol-generating device' relates to a device that interacts with an aerosol-forming substrate to generate an aerosol. The aerosol-generating article of the present invention may itself comprise a heat source and at least one heat-conducting element for transferring heat from the heat source to the aerosol-forming substrate of the article.

The aerosol-generating article of the present invention may be a smoking article, such as a filter cigarette or other smoking article, in which an aerosol-generating substrate comprises a tobacco material that is combusted to form smoke. Therefore, in any of the embodiments described above, the aerosol-generating substrate may comprise a tobacco rod. Furthermore, in any of the embodiments described above, the mouthpiece may be a filter. In such embodiments, the filter may be secured to the tobacco rod by a tipping paper.

The mouthpiece may comprise one or more segments disposed upstream of the hollow tubular segment. The hollow tubular segment may be directly adjacent to the aerosol-forming substrate. The fibrous material of the hollow tube may comprise cellulose based fibers, such as cellulose acetate fibers.

The mouthpiece may be secured to at least a downstream portion of the aerosol forming substrate. For example, a wrapper such as a tipping wrapper may circumscribes the mouthpiece and at least a downstream end portion of the aerosol forming substrate to join the mouthpiece and aerosol-forming substrate together.

According to a second aspect of the invention, there is provided a method of forming a hollow tubular segment for a mouthpiece of an aerosol-generating article. The method comprises: conveying a continuous band of fibrous material; shaping the continuous band into an annular profile; affixing a polymeric film to the inner surface of the shaped continuous band; and cutting a portion of the continuous band after the polymeric film has been affixed to its inner surface to form a hollow tubular segment for a mouthpiece of an aerosol-generating article.

In an implementation of the second aspect of the invention, there is provided a method of forming a hollow tubular segment for a mouthpiece of an aerosol-generating article, the method comprising: conveying a continuous band of fibrous material; shaping the continuous band into an annular profile; affixing a polymeric film to the inner surface of the shaped continuous band, wherein the fibrous material of the continuous band comprises fibers formed of a first type of polymer and the polymeric film comprises at least about 20 percent of the first type of polymer; and cutting a portion of the continuous band after the polymeric film has been affixed to its inner surface to form a hollow tubular segment for a mouthpiece of an aerosol-generating article.

The step of affixing a polymeric film to the inner surface of the shaped continuous band may comprise: spraying a binder for the fibrous material over the shaped continuous band, wherein at least a portion of the sprayed binder resides on the inner surface of the shaped continuous band; contacting the polymeric film with the inner surface of the shaped continuous band, wherein the polymeric film comprises a first type of polymer, and the binder is suitable for binding the first type of polymer of the polymeric film to the such that the step of contacting results in the film becoming bound to the inner surface of the shaped continuous band.

The method of the second aspect of the invention may advantageously allow for the hollow tubular segment of the first aspect of the invention to be manufactured on existing machinery using existing processes and techniques, with little or no modification.

According to a third aspect of the invention, there is provided a mouthpiece for an aerosol-generating article comprising: a hollow tubular segment at its downstream end defining a mouth end cavity, and wherein the hollow tubular segment comprises a hollow tube of fibrous material, and a polymeric film secured to the inner surface of the hollow tube.

In an implementation of the third aspect of the invention, there is provided a mouthpiece for an aerosol-generating article comprising: a hollow tubular segment at its downstream end defining a mouth end cavity, and wherein the hollow tubular segment comprises a hollow tube of fibrous material, and a polymeric film secured to the inner surface of the hollow tube, wherein the fibrous material of the hollow tube comprises fibers formed of a first type of polymer and the polymeric film comprises at least about 20 percent of the first type of polymer The mouthpiece of the third aspect of the invention may have any of the features described about in respect of the first aspect of the invention.

It will be appreciated that preferred features described above in relation to one aspect of the invention may also be applicable to other aspects of the invention.

Embodiments of the invention will now be described, by way of example only, with reference to the accompanying drawings, in which.

Figure 1:
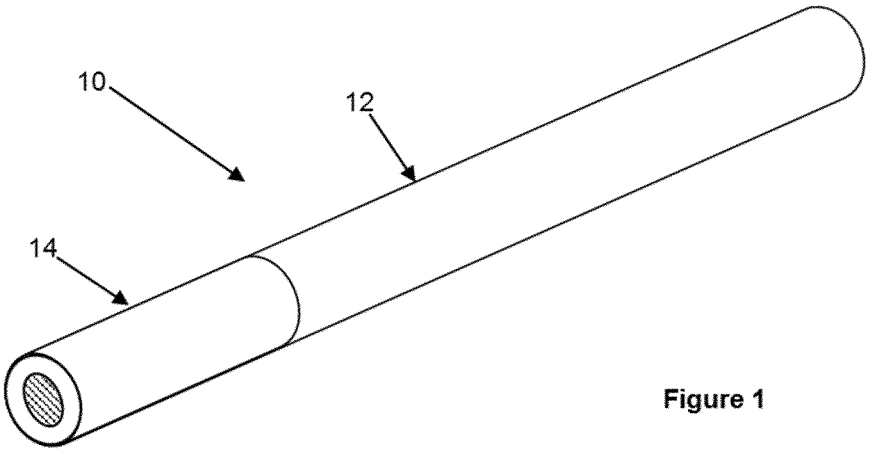
FIG. 1 shows an aerosol-generating article in accordance with a first embodiment of the present invention.
Figure 2:
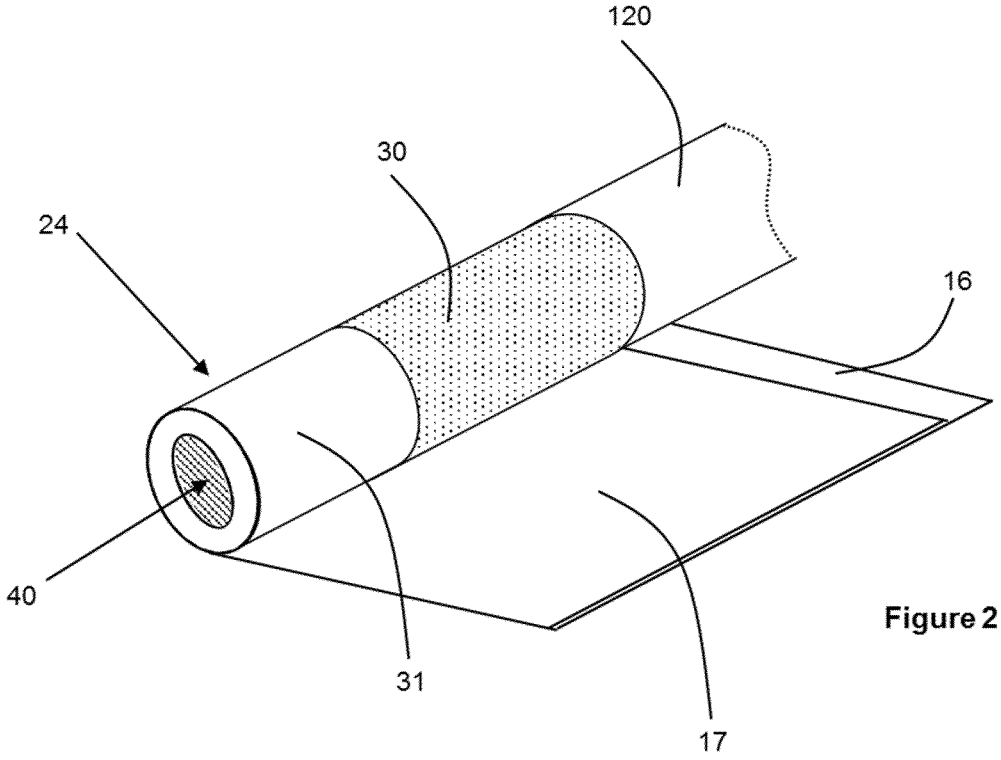
FIG. 2 shows a view of the aerosol-generating article of FIG. 1 with the mouthpiece unwrapped.

FIGS. 1 and 2 illustrate an aerosol-generating article 10 in accordance with a first embodiment the present invention. The article is in the form of a smoking article. The smoking article 10 comprises an aerosol forming substrate in the form of wrapped rod 12 of tobacco cut filler. The rod 12 is attached at one end to a mouthpiece, in the form of axially aligned filter 14. A band of tipping paper 16 circumscribes the filter 14 and a portion 120 of the wrapped rod 12 of tobacco to join together the two portions of the smoking article 10.

As shown in FIG. 2, the filter 14 comprises a hollow tubular segment 24. The hollow tubular segment 24 comprises a hollow tube 31 of elastically deformable fibrous filtration material, such as cellulose acetate tow. The hollow tubular segment 24 is at the downstream end of the filter 14, and defines a mouth end cavity 40 of the article 10. Upstream of the hollow tubular segment 24 is a filter segment 30, also formed of fibrous filtration material, such as cellulose acetate tow. The filter segment 30 is adjacent to the hollow tubular segment 24. The filter segment 30 and hollow tubular segment 24 are secured to one another by a circumscribing combining plug wrap 17.

Figure 3:
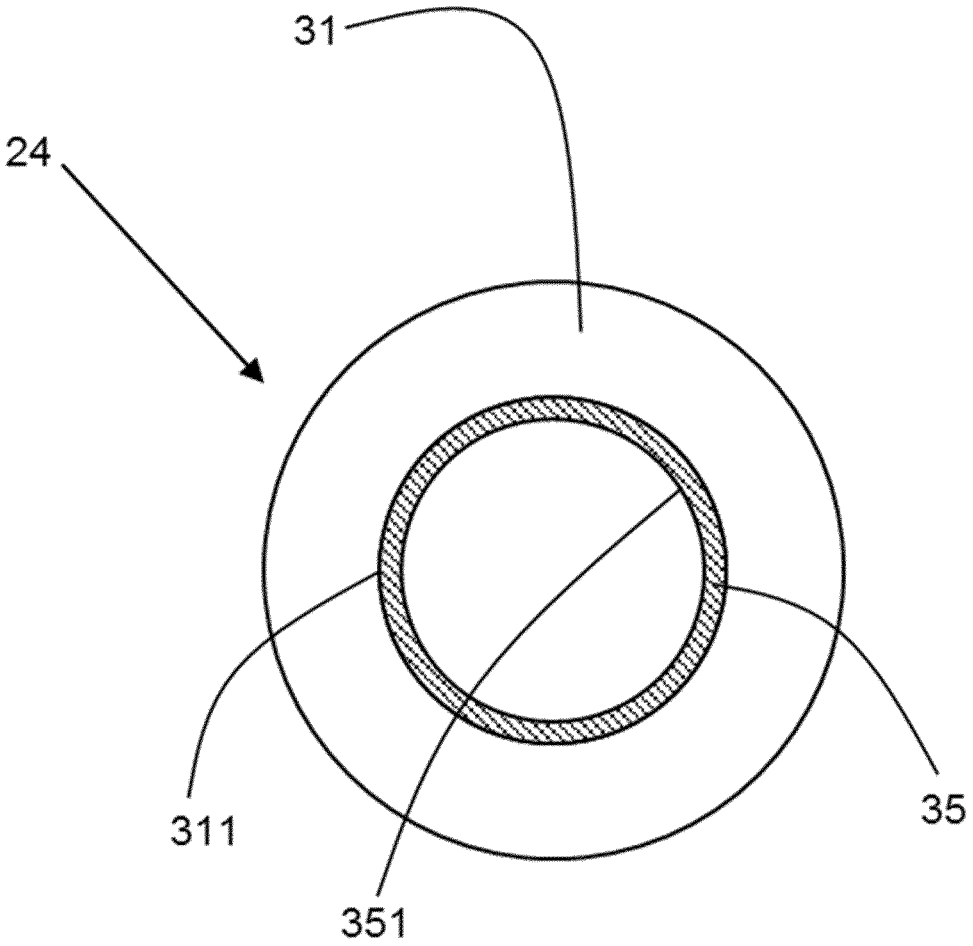
FIG. 3 shows a cross sectional view of the hollow tubular segment of FIG. 2 as taken perpendicular to the longitudinal axis of the aerosol-generating article.

As can be best seen from FIG. 3, in addition to comprising the hollow tube of fibrous material 31, the hollow tubular segment 24 also comprises a polymeric film 35. The polymeric film 35 is secured to the inner surface 311 of the hollow tube 31. This means that the inner surface of the hollow tubular segment 24 is formed by the inner surface 351 of the polymeric film 35. The thickness of the polymeric film 35 relative to the thickness of the hollow tube 31 is not shown to scale in FIG. 3. The polymeric film 35 may be secured to the hollow tube 31 by way of a binder, by way of an adhesive or by way of both a binder and an adhesive. The polymeric film 35 may have a colour that is different to the colour of the hollow tube 31.

The invention claimed is:

1. An aerosol-generating article comprising:

an aerosol generating substrate; and a mouthpiece disposed downstream of the aerosol-generating substrate, wherein the mouthpiece comprises a hollow tubular segment at its downstream end defining a mouth end cavity, wherein the hollow tubular segment comprises a hollow tube of fibrous material, and a polymeric film secured to an inner surface of the hollow tube, and wherein the fibrous material of the hollow tube comprises fibers formed of a first type of polymer and the polymeric film comprises at least about 20 percent of the first type of polymer, wherein the polymeric film has a thickness of from about 14 micrometres to about 90 micrometres.

2. An aerosol-generating article according to claim 1, wherein the tubular segment comprises a binder for binding the fibers of the hollow tube together and for binding the film to the inner surface of the hollow tube.

3. An aerosol-generating article according to claim 2, wherein the binder is a solvent for the fibers of the first type of polymer.

4. An aerosol-generating article according to claim 3, wherein the first type of polymer is an acetate ester of cellulose and the binder is an ester of glycerol.

5. An aerosol-generating article according to claim 4, wherein the acetate ester of cellulose is selected from the group of cellulose acetate, cellulose diacetate and cellulose triacetate.

6. An aerosol-generating article according to claim 5, wherein the ester of glycerol is triacetin.

7. An aerosol-generating article according to claim 5, further comprising an adhesive for securing the polymeric film to the inner surface of the hollow tube.

8. An aerosol-generating article according to claim 5, wherein the hollow tubular segment has a substantially annular cross section.

9. An aerosol-generating article according to claim 5, wherein the polymeric film is secured to an entire inner surface of the hollow tube of fibrous material.

10. An aerosol-generating article according to claim 5, wherein the polymeric film has an indicia on its inner surface.

11. An aerosol-generating article according to claim 4, wherein the ester of glycerol is triacetin.

12. An aerosol-generating article according to claim 1, further comprising an adhesive for securing the polymeric film to the inner surface of the hollow tube.

13. An aerosol-generating article according to claim 1, wherein the hollow tubular segment has a substantially annular cross section.

14. An aerosol-generating article according to claim 1, wherein the polymeric film is secured to an entire inner surface of the hollow tube of fibrous material.

15. An aerosol-generating article according to claim 1, wherein the polymeric film has an indicia on its inner surface.

16. A method of forming a hollow tubular segment for a mouthpiece of an aerosol-generating article, the method comprising:

conveying a continuous band of fibrous material;

shaping the continuous band into an annular profile;

affixing a polymeric film to an inner surface of the shaped continuous band, wherein the fibrous material of the continuous band comprises fibers formed of a first type of polymer and the polymeric film comprises at least about 20 percent of the first type of polymer; and cutting a portion of the continuous band after the polymeric film has been affixed to its inner surface to form a hollow tubular segment for a mouthpiece of an aerosol-generating article, wherein the polymeric film has a thickness of from about 14 micrometres to about 90 micrometres.

17. A method according to claim 16, wherein the step of affixing a polymeric film to the inner surface of the shaped continuous band comprises:

spraying a binder for the fibrous material over the shaped continuous band, wherein at least a portion of the sprayed binder resides on the inner surface of the shaped continuous band; and contacting the polymeric film with the inner surface of the shaped continuous band, wherein the polymeric film comprises a first type of polymer, and the binder is suitable for binding the first type of polymer of the polymeric film to the inner surface of the shaped continuous band such that the step of contacting results in the film becoming bound to the inner surface of the shaped continuous band.

18. A mouthpiece for an aerosol-generating article comprising:

a hollow tubular segment at its downstream end defining a mouth end cavity, and wherein the hollow tubular segment comprises a hollow tube of fibrous material, and a polymeric film secured to an inner surface of the hollow tube, and wherein the fibrous material of the hollow tube comprises fibers formed of a first type of polymer and the polymeric film comprises at least about 20 percent of the first type of polymer, wherein the polymeric film has a thickness of from about 14 micrometres to about 90 micrometres.

* * * * *